United States Patent [19]

Horlander

[11] 4,435,634

[45] Mar. 6, 1984

[54] THERMAL PRINTER EDGE COMPENSATION

[75] Inventor: Frank J. Horlander, Lexington, Ky.

[73] Assignee: International Business Machines Corporation, Armonk, N.Y.

[21] Appl. No.: 452,347

[22] Filed: Dec. 22, 1982

[51] Int. Cl.[3] ..... B41J 3/20; H05B 3/00

[52] U.S. Cl. ..... 219/216; 346/76 PH; 400/120; 307/18; 307/24; 323/313

[58] Field of Search ..... 219/216 PH, 501; 346/76 PH, 76 R; 400/120; 307/18, 19, 24; 323/312–316; 328/172, 173

[56] References Cited

U.S. PATENT DOCUMENTS

| | | | |
|---|---|---|---|
| 3,457,493 | 7/1969 | Shoemaker | 307/24 |
| 4,092,649 | 5/1978 | Miller | 346/76 R |
| 4,345,845 | 8/1982 | Bohnhoff et al. | 400/120 |
| 4,350,449 | 9/1982 | Countryman et al. | 400/120 |
| 4,404,567 | 9/1983 | Katsuragi | 346/76 PH |

*Primary Examiner*—B. A. Reynolds
*Assistant Examiner*—Teresa J. Walberg
*Attorney, Agent, or Firm*—John A. Brady

[57] ABSTRACT

A current-drive circuit (FIG. 1) is provided to drive each of forty electrodes 41. When selected, the circuit forces line 27 to a level of drive voltage Vdr minus a current-level reference voltage Vlev. A constant current is produced across resistor 25. Line 27 is connected through resistor 29*a* to line 27*a*, which is the same point in the current-drive circuit of the adjoining electrode 41*a* (FIG. 3) on one side of electrode 41. Line 27 is similarly connected through resistor 29*b* to line 27*b*, which is the same point in the current-drive circuit of the adjoining electrode 41*b* (FIG. 3) on the opposite side of electrode 41. Selection of the drive circuit also connects line 27 to the associated electrode 41. An unselected drive circuit for an adjoining electrode, such as the one connected to drive electrode 41*a*, has line 27*a* floating to the level dictated by Vdr through its resistor 25*a*, while its electrode 41 is disconnected. Current from the unselected circuit through resistor 29*a* adds to the current in electrode 41, thereby eliminating lightened-edge printing from current spreading.

24 Claims, 4 Drawing Figures

THERMAL PRINTER EDGE COMPENSATION

CROSS REFERENCE TO RELATED APPLICATION

A United States Patent Application filed concurrently with this application entitled "Regulated Current Source For Thermal Printhead" by Timothy P. Craig et al, co-workers with the inventor of this application, discloses and claims the regulated current driver system which appears in the preferred embodiment here described of this invention.

TECHNICAL FIELD

This invention relates to driver circuits for thermal printheads employing a ribbon that generates localized heat internally in response to electrical current. The localized heat then serves to cause marks to be formed on a receiving medium. Typically, the electrical signals are applied by printhead electrodes wiping across an outer layer of the ribbon which is characterized by moderate resistivity. These signals migrate inwardly to a layer that is highly conductive (typically an aluminum layer) with localized heating occurring in the process. The pass is completed by an electrode connected to ground which intersects the ribbon, preferably at the highly conductive layer, at a point spaced from the printhead. This invention is directed to improving the quality of printing by eliminating the spreading of current at electrodes driven when contiguous electrodes are not driven. The spreading reduces effective heat, resulting in lighter printing than from electrodes driven while contiguous electrodes are also driven.

BACKGROUND ART

The printing system to which this invention is directed and current control systems for the printhead are disclosed in U.S. Pat. No. 4,350,449 to Countryman et al and U.S. Pat. No. 4,345,845 to A. E. Bohnhoff et al, which is herein incorporated by reference. Those patents do not address the spreading of current at electrodes when one or more contiguous electrodes are not driven.

The existence of a current-spreading effect and resulting lighter printing at image edges may be observed from close inspection. U.S. Pat. No. 4,217,480 to F. C. Livermore et al describes such a current-spreading problem and describes the use of a negative-temperature-coefficient resistance to counteract the problem. In contrast, the subject invention employs an interconnection between adjoining electrode drivers.

DISCLOSURE OF THE INVENTION

Print-quality tends to deteriorate from electrodes driven when a contiguous electrode is not driven. This is from the spreading of current toward the undriven electrode, resulting in lighter printing under the driven electrode.

In the type of electrode-driver system to which this invention is directed, each electrode is driven by a circuit having an operating voltage connected across a resistor to a point which is switched into and out of connection with the electrode to be driven by that circuit. When the circuit is selected, the point is forced to a predetermined voltage reference level and the electrode is switched into connection to the point. Current from the resistor is defined by the two voltages, which are across it, and passes into the electrode. When the circuit is unselected, the point is isolated from any reference level and the switch disconnects the electrode. In specific designs of primary interest, the operating voltage and the reference voltage vary together in response to changes during printing, and the current out is therefore a constant current.

In accordance with this invention, the points carrying the reference level on drivers for next adjacent electrode are connected through a resistor. This functions to immediately provide increased current when an electrode contiguous to one which is being driven is not driven. When more than one such contiguous electrode is not driven, the amount of current is increased proportionally. This current is supplied by the path including the resistor to the driver for the undriven electrode and the operating voltage at that driver. That operating voltage is effective to drive current through a resistive connection to a point carrying the lower reference level in a drive circuit for an adjoining electrode.

In the more specific aspects disclosed, forty electrodes in a column are driven by forty separate drivers. Drivers for electrodes on opposite sides are connected by a resistance element at the reference level points. All of the drivers, the electrodes, and interconnecting resistors are substantially identical.

The invention is achieved by exceptionally few and economic additions to the system. In fact, the additions may be essentially only a single, relatively small resistor in each interconnection between driver circuits.

In the preferred embodiment, end electrodes are not compensated for current spread away from the column. An outer circuit equivalent to an unselected electrode driver could be provided, but this is considered uneconomic as the outer electrodes are usually not significant to the quality of printers. Similarly, two, central electrodes are not interconnected with the resistance element. This is because the electrodes are on two, separate substrates (chips) and the interconnection would require a terminal for that purpose. The central electrodes are so often driven or not driven simultaneously that the interconnect was considered unnecessary.

In practice, the proper compensating current will be much less, for example one-sixth, of the usual drive circuit, so the resistance interconnection will be relatively large. Some current will flow from all adjoining undriven drivers, but where the resistance connection is at least in the order of magnitude of five times that of the current-defining resistor in the driver circuit, current from other than a next adjoining, undriven drive circuit is not of major significance.

BRIEF DESCRIPTION OF THE DRAWING

A detailed description of the best and preferred implementation is described in detail below with reference to the following drawing in which.

BEST MODE FOR CARRYING OUT THE INVENTION

In the subsequent discussion, all transistors are bipolar and this characteristic will not be further mentioned.

As is well understood, the transistors are activated for passing current by signals to their bases, which constitute control terminals. Where a voltage is designated with a numerical label in addition to a capital V label, the voltage is, for the immediate purposes of this invention, a steady-state operating or reference voltage provided by the system. Vref refers to a fixed, relatively accurate reference voltage. Other voltages are of variable levels produced by the circuits. In the circuits as shown, typical values of voltage are V1: +38 volts; V2: V1−1 volt, V3: −5 volts; Vref: a relatively fixed 1 volt+V3; and V4:+5 volts.

Figure 1:
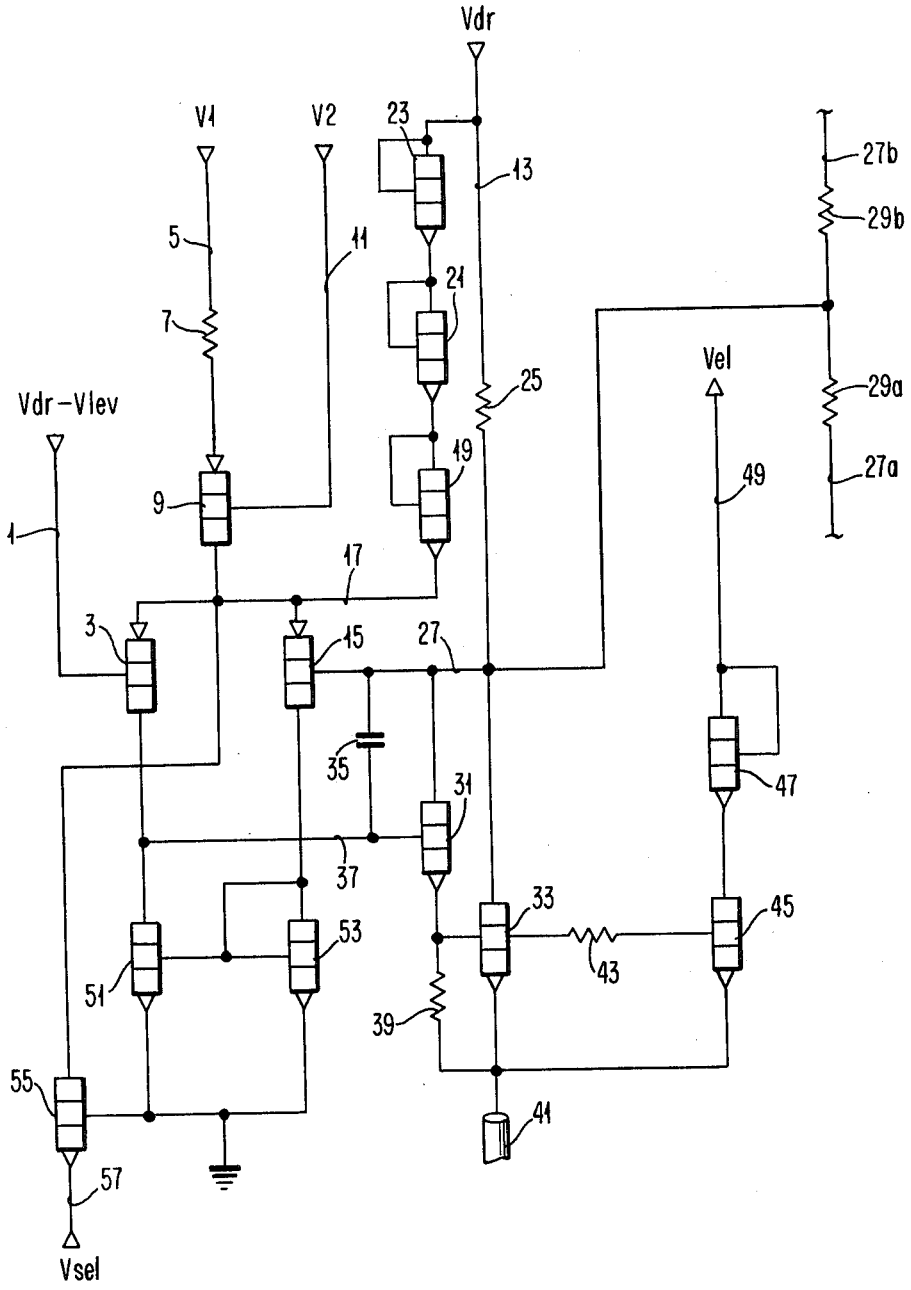
FIG. 1 is a circuit diagram of the current driver.

FIG. 1 is a circuit diagram of the current driver for each print electrode. It will be understood that forty such drivers are provided where the number of printheads are, as in this preferred embodiment, forty. More generally, one of these current drivers is provided and connected to one each of the printhead electrodes.

A voltage Vdr-Vlev is provided on line 1 to the base of transistor 3. Voltage Vdr is a regulated input voltage generated as described in connection with FIG. 2. Voltage Vlev is a print-level-reference voltage of a level directly related in magnitude to the level of print current sought. Generation and definition of this reference voltage forms no direct part of this invention. Generation of Vlev-Vdr is described in connection with FIG. 4. Voltage V1 is applied to line 5 through resistor 7 to the emitter of transistor 9. Voltage V2 is applied on line 11 to the base of transistor 9, and these voltages are scaled with respect to each other and to resistor 7 to provide a suitable constant current from the collector of transistor 9. The constant current provides stable and reliable circuit operation using moderate-size, on-substrate (on-chip) components.

Vdr is the drive voltage employed to power electrode current as will be described. Vdr is applied on line 13 and is applied to the emitter of transistors 3 and 15 through line 17, which connects through a device 19 connected as a diode, device 21 connected as a diode, and device 23 connected as a diode. These diodes 19, 21 and 23 are of polarity to be forward biased with respect to Vdr. During selection of the circuit to drive of an electrode, transistors 3 and 15 are powered by V1 as will be described. Line 17 is a low-voltage-level source to protect transistors 3 and 15 from breakdown when the circuit is unselected as will be described. In the unselected status, the voltage applied at the emitter of transistors 3 and 15 from line 17 is Vdr reduced by the three diode drops across device 17, device 19, and device 21.

Line 13 connects through resistor 25 to line 27. Line 27 connects to the base of transistor 15 and to a resistor 29*a* and 29*b*, which are connected to lines 27*a* and 27*b*, respectively, of the drive circuits for the adjoining electrodes for a purpose as will be described. The function of resistors 29*a* and 29*b* connected as shown is the gist of the invention to which the application mentioned under the heading "Cross Reference to Related Applications" above is directed.

Line 27 is connected to the collector of transistor 31 and to the collector of transistor 33 and is connected through capacitor 35 to line 37, which is connected to the collector of transistor 3 and to the base of transistor 31. The emitter of transistor 31 is connected to the base of transistor 33 and through resistor 39 to the electrode 41. A base of transistor 33 is connected through resistor 43 to the base of transistor 45. The base of transistor 45 is connected through device 47 connected as a diode to line 49. Line 49 is connected to identical lines at other drives and, accordingly, carries a signal Vel, which is the minimum electrode voltage of all electrodes.

The collector of transistor 3 is connected to the collector of transistor 51, which is oppositely poled to the polarity of transistor 3 (specifically transistor 3 is PNP and transistor 51 is NPN). Similarly, the collector of transistor 53 is connected to the collector of transistor 15 and is oppositely polled to the polarity of transistor 15. The base and collector of transistor 53 are electrically tied together, and the bases of transistors 51 and 53 are also electrically tied together. The emitters of transistors 51 and 53 are connected to ground. Transistor 55 is poled the same as transistors 51 and 53. The emitter of transistor 55 is connected to line 57 which receives a selection voltage Vsel. The base of transistor 55 is connected to ground.

Vsel will be up, thereby switching transistor 55 off, when the electrode 41 to which the current-drive circuit is connected is to be driven. When that electrode is not selected to be driven, Vsel is down, thereby switching the transistor 55 on and drawing the constant current from collector of transistor 9, as well as lowering the voltage level at the emitters of transistors 3 and 15 to a level such that the circuit does not further respond to an input signal on line 1 and the voltage on line 13. At the same time, transistor 45 is switched off, thereby removing the voltage level on the associated electrode 41 as a component of Vel on line 49.

The signal Vlev on line 1 may not be frequently varied, as it changed only where the heating from the electrodes 41 is to be adjusted, such as for different characteristics of the ribbon being printed on or to achieve desired effects.

When Vsel is high, the input voltage on line 1 permits transistor 3 to be driven on, providing current from the collector of transistor 3. The voltage on line 1, Vdr-Vlev acts across the base-to-emitter junction of transistor 3, the emitter of which is at the voltage produced by the constant current from transistor 9. That voltage from transistor 9 appears at the emitters of transistors 3 and 15 and is of proper polarity and magnitude for current flow through transistor 3 and 15.

As transistor 3 is turned on, a potential appears on line 37 turning transistors 31 and 33 on, which permits transistor 15 to be driven on. Current from the collector of transistor 15 appears at the collector and base of transistor 53, which are tied together. Transistor 51 and transistor 53 constitute a standard current mirror. Transistor 53 is biased on, and transistor 51 is identically biased on as the base of transistors 51 and 53 are tied together. Transistors 51 and 53 have identical characteristics. They, therefore, come to the same base potential and carry identical current. As base-to-emitter voltage defines total current from the emitter for all transistors short of saturation and as the currents involved are selected to be less than saturation, the current from the emitter of transistor 51 is identical to that from the emitter of transistor 53. The currents are said to be mirrored. The voltage at the collector of transistor 51 is high and variable with current flowing through transistor 51.

Transistor 3 constitutes the input side of a differential amplifier with its base being a control element. Transistor 15 in series with transistor 53 will carry mirrored, substantially identical current to that in transistor 51. The base of transistor 15 constitutes a second, controlled input. Line 27 thus corresponds to line 1 in the differential circuit.

As transistor 3 and transistor 15 have substantially identical characteristics, the current produced and associated voltage levels are identical at corresponding places in the two circuit lines having those elements. Accordingly, the voltage at the base of transistor 15 is the same as the voltage of the base at transistor 3. The voltage at the base of transistor 15 appears on line 27 which is connected through transistor 33 to electrode 41.

Transistor 31 remains switched on by the potential at the collector of transistor 3, and transistor 31 switches on transistor 33. Accordingly, electrode 41 is driven through transistor 33, which is driven in its active region and therefore interposes a voltage drop equal to that between line 27 and electrode 41. The amount of current is fixed by the difference between Vdr on line 13 and the voltage level on line 27 in an ordinary series electrical circuit across resistor 25. Vdr on line 13 provides the power to drive this current. Capacitor 35 functions as a compensating capacitor to prevent oscillations, and resistor 39 is of relatively large resistance effective to direct current to the base of transistor 33 while assuring turn off of transistor 33 when transistor 31 is off. Transistor 45 is biased on through resistor 43, which is also of relatively large resistance to reduce current flow. Device 47 is effectively a diode as will be more fully discussed in connection with FIG. 2. Diode 47 is connected through line 49 to a point at which all of the forty circuits identical to that of FIG. 1, one for each electrode 41, is tied. When the base of transistor 33 is biased low, the drive circuit is not selected. The base of transistor 45 is then also low, thereby switching off transistor 45 and isolating the undriven electrode 41 from line 49.

Figure 2:
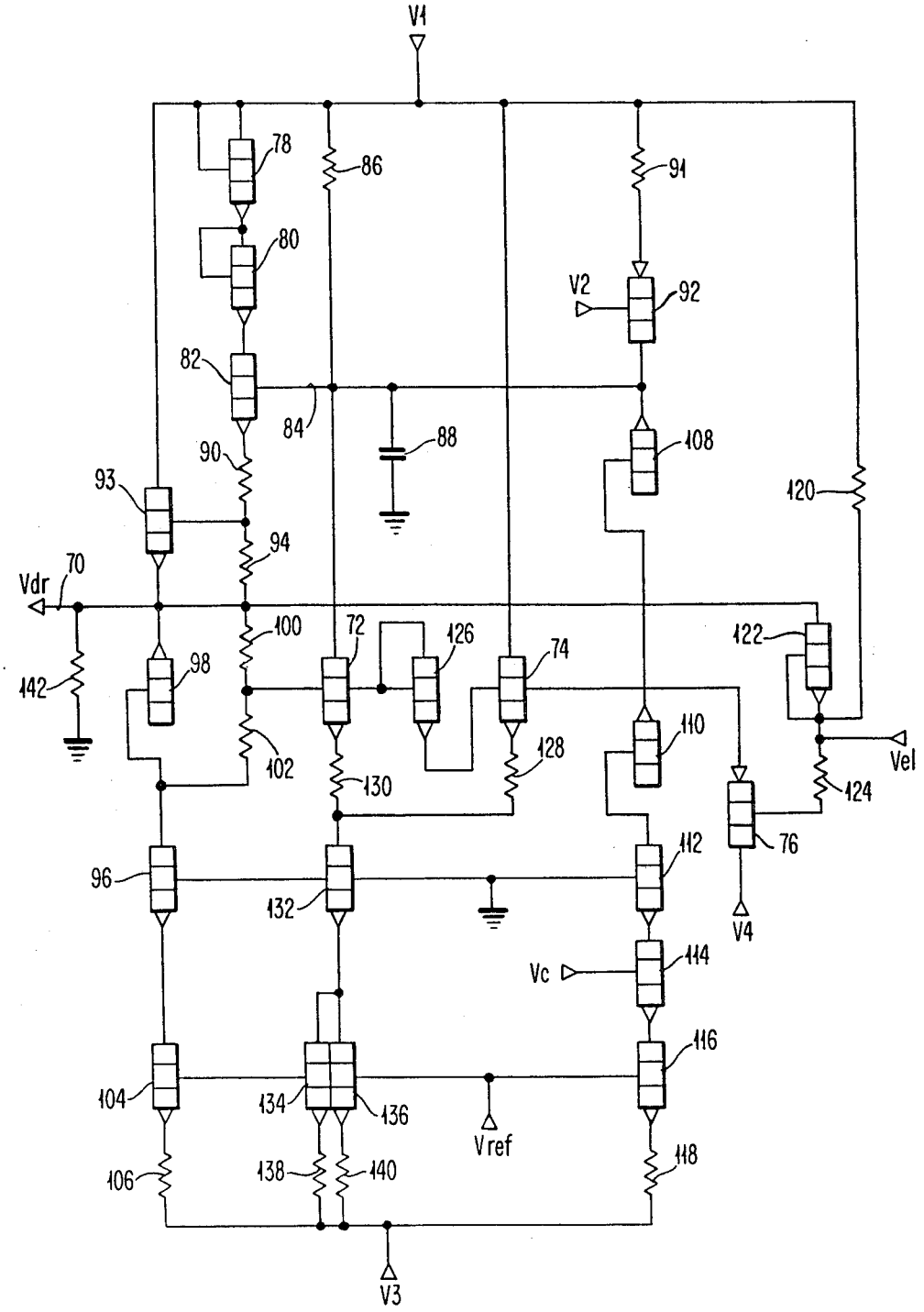
FIG. 2 is a circuit diagram of the voltage regulator.

FIG. 2 is diagram of the single voltage regulator circuit effective to vary the voltage Vdr employed with the forty drive circuits of FIG. 1 in the preferred embodiment. The regulated Vdr is produced on line 70. Regulation is by a circuit including as major elements transistors 72 and 74 connected to Vel through transistor 76. Operating voltage V1, shown at the top of the circuit, applies a voltage to device 78, connected as a diode, which is connected to device 80, also connected as a diode, to transistor 82. The base of transistor 82 is connected to the collector of transistor 72. Operating voltage V1 is applied through resistor 86 to line 84. Line 84 is also connected to capacitor 88, which is connected on its other side to ground.

Operating voltage V1 is connected through resistor 91 and to the emitter of transistor 92. The base of transistor 92 is connected to a reference voltage V2. The emitter of transistor 82 is connected through resistor 90 to the base of transistor 93, the emitter of which is connected to line 70. A resistor 94 connects the base of transistor 93 also to line 70. Line 70 is connected to the collector of transistor 96 across device 98, which is a bipolar transistor connected as a Zener diode. Accordingly, device 98 sets a fixed voltage drop between line 70 and the collector of transistor 96. Two large resistors 100 and 102 are connected between line 70 and the collector of transistor 96. The junction of resistors 100 and 102 is connected to the base of transistor 72. The emitter of transistor 96 is connected to the collector of transistor 104. The base of transistor 104 is connected to a source of accurate reference potential, Vref. The emitter of transistor 104 is connected through resistor 106 to a source of operating voltage V3. Transistor 96 and transistor 104 as connected form a constant-current source. As such, they provide stable and reliable circuit operation using moderate-size, on-chip components.

Line 84 is connected through device 108, connected as a Zener diode, to a second device 110, also connected as a Zener diode, through transistor 112, the base of which is connected to ground and the emitter of which is connected to the collector of transistor 114. The emitter of transistor 114 is connected to the collector of transistor 116, the base of which is connected to Vref. The emitter of transistor 116 is connected through resistor 118 to the V3. A control signal Vc is applied to the base of transistor 114, this being effective to deactivate the regulator circuit as will be described.

Operating voltage V1 is connected through a resistor 120 to Vel. Vel is connected through device 122 connected as a diode, to line 70. Vel is also connected through resistor 124 to the base of transistor 76. The emitter of transistor 76 is connected to the base of transistor 74. The collector of transistor 76 is connected to an operating potential V4. The base of transistor 74 and the base of transistor 72 are connected through device 126, connected as a diode. The polarity for connection of diode 126 is such that it is not operative during most circuit operation but does protect device 74 against back biasing during quick shifts of Vdr.

The emitter of transistor 74 is connected through resistor 128 to a resistor 130, the other side of which is connected to the emitter of transistor 72. The junction of resistors 128 and 130 is connected to the collector of transistor 132, the base of which is connected to ground. The emitter of transistor 132 is connected to parallel devices 134 and 136, the bases of which are connected to Vref. The emitters of devices 134 and 136 are connected through resistors 138 and 140, the other sides of which are connected to the V3.

Transistors 132, 134 and 136 as connected form a relatively-large-capacity, constant-current source. As such, they provide stable and reliable circuit operation using moderate-size, on-chip components. Lastly, line 70 is connected to ground through a large resistor 142.

As Vdr drives all forty electrodes 41, this circuit Transistor 92, capacitor 88 and resistors 86 and 120 typically would be large, off-chip elements. Resistor 142 dissipates large power and may be located off-chip for that reason. Other elements may be off-chip to allow their value to be more readily changed to modify or optimize a specific circuit. In operation, diode devices 78 and 80 connected to the collector of transistor 82 are merely voltage-level positioners. The circuit of resistor 86 to line 84 and to ground through capacitor 88 is a time-delay circuit connecting voltage source V1 to line 84, so that V1 can supply power for necessary current shifts. Such changes of course, are dependent on the time-factors resulting from capacitor 88 being charged primarily by transistor 92 as a constant-current source and secondarily by current through resistor 86. Capacitor 88, when charged, can discharge quickly through transistor 72. Reference voltage V2, applied to the base of transistor 92, is effective to operate transistor 92 at the voltage level applied by resistor 91. Accordingly, operating voltage V1 is the ultimate source of electrical power for the circuit, while voltage levels are set by the circuit relationships and other reference levels as described. Vdr on line 70 is always at a sufficient level to satisfy the breakdown level across device 98. Accordingly, as the current through the base of transistor 72 is negligible, a potential appears at the junction of resistor 100 and resistor 102 which is a fixed amount less than the varying potential on line 70.

Voltage Vel applied from a drive electrode 41 (FIG. 1) is effective to determine the voltage of Vdr. Vel controls the potential on line 70 through the following circuit relationships. Vel less the base-to-emitter drop across transistor 76 is transmitted by transistor 76 to the base of transistor 74. The emitter of transistor 74 is connected through resistor 128 and through resistor 130 to the emitter of transistor 72. Transistors 72 and 74 have identical characteristics. Resistors 128 and 130 have identical resistances. Currents from the emitters of the two transistors 72 and 74 are determined by their base-to-emitter voltages. Because the junction of resistors 128 and 130 is supplied with a constant current from transistor 132, an increase or decrease in conduction in transistor 74 causes an opposite change in current flow in resistor 130. As line 84 is connected across transistor 72, the potential on line 84 increases with decreased current through transistor 72 and decreases with increased current through transistor 72. This provides a differential action which results in a steady-state condition in which the currents in resistors 130 and 128 differ an amount related to the difference in potentials to the bases of transistors 72 and 74. Resistors 128 and 130 are of equal value and the component values are selected so that the voltage on the base of transistor 72 is slightly less than that on the base of transistor 74. The base of transistor 72 is connected to Vdr on line 70 through resistor 100, and resistor 100 is in a voltage-divider-circuit with transistor 98 as a Zener diode and resistor 102. The end of resistor 102 tied to diode 98 is therefore held Vdr less the breakdown voltage of diode 98. The voltage at the junction of resistor 100 and resistor 102 thus moves directly with Vdr. A change in voltage input to transistor 74 from Vel is responded to by the differential circuit by a change in the same sense of Vdr, thereby keeping unchanged currents in resistors 128 and 130.

Consequently, the cumulative voltage change through the resistors 130 and 128 is effectively constant. Likewise, the current through resistor 124 is negligibly small. (Resistors 130 and 128, as well as resistor 86 also function to reduce AC gain and similar undesired effects.)

Accordingly, Vdr is defined by the total of the following: the fixed drop across resistor 100, a small constant representative of the currents in resistors 130 and 126, the base-to-emitter drop in transistor 76, and by Vel, the current in resistor 124 being so small as to be negligable. The potentials from base-to-emitter of transistors 72 and 74 are of opposite polarity and therefore cancel. Similarly, the drops across registers 128 and 130 are oppositely polled and the voltage across resistor 130 is cancelled by the larger voltage across resistor 128. This net drop across resistor 128 and 130 is in the opposite polarity to Vel and is approximately one-half the base-to-emitter drop of transistor 76. In a typical implementation, the circuit value are selected so that Vdr is about 5 volts greater than Vel.

Vdr is thereby set at a substantially fixed level above Vel, and Vdr varies the same amount and in the same sense as Vel. Resistor 142 is a large resistor and, accordingly, serves only as a current sink during circuit operation. When no electrodes are driven, Vel is clamped one diode drop above Vdr by operating voltage V1 acting through resistor 120 and through forward-biased diode 122.

Finally, a signal Vc to the base of transistor 114 is effective to draw the voltage on line 84 down greatly and thereby disable the circuit operation. Transistor 112 is designed to saturate. Line 84 is brought to a low level, defined by the sum of the voltages across the Zener diodes 108 and 110 and saturated transistor 112. That voltage is selected to be large enough to keep internal, reference levels from having false, negative levels at turn-on. Resistors 142 and 94 keep transistor 92 in the active region during intermediate periods. Resistor 90 prevents oscillations from capacitive loads.

This circuit thereby provides a voltage which is directly related to the voltage Vel. In a preferred embodiment with forty current driver circuits such as FIG. 1, a number from one to forty may be selected and operating to drive up to forty electrodes at one time. These forty circuits are tied to Vel but are isolated from one another by the diode 47 in each of the current drive circuits. Because of the polarity of the diode 47, the electrode 41 having the lowest potential will define a voltage level Vel when one or more circuits are operating.

The interrelationship of the current drive circuits of FIG. 1 and the regulated voltage circuit of FIG. 2 may now be more completely explained. The voltage on driven electrodes 41 typically varies, one reason being that the increased current when a number of electrodes are driven simultaneously increases voltage drop in the ground path. A constant current to each electrode 41 being driven is desirable. To obtain that constant current by changing the biasing on operative transistors and the like requires that the transistors be capable of a wide range of operation which can be a significant design limitation and can result in a design which cannot be miniaturized. In accordance with this invention, the constant current is attained in a circuit in which the voltage levels on each side of a resistive element are changed to produce the current.

Assuming operation at a first level of Vdr, the line 27 in FIG. 1 is connected to a point in the output drive line of a differential amplifier comprising a constant current source driving transistors 3 and 51 as the input side and transistors 15 and 53 as the controlled side. The potential on line 37 switches on transistors 31, 33 and 45. Equilibrium is reached when potential on line 27 is sufficient to bring identical current through transistors 3 and 15. (This ignores the small current on line 37 which is negligible.) The current-mirror effect of transistor 51 and 53 forces the voltage at line 27 to very closely seek the same level as the votage at line 1. (The small current on line 37 being also insignificant to this.) With any increase of Vel, Vdr is increased the same amount by the circuit in FIG. 2 as described. The voltage on line 1 to the base of transistor 3 is a direct function of Vdr as previously mentioned, and, accordingly, that voltage goes up in the same amount as Vel.

The voltage on line 27 follows that on line 1 and also increases the same amount as Vel. The current to the electrode is defined by the increased Vdr applied across resistor 25 to the equally increased voltage on line 27. The change in voltage of Vdr is offset by the change in the level of voltage on line 27 in the same amount. Current remains the same, since the net voltage across resistor 25 remains identical. At the same time, the level of current through transistors 3 and 15 is unchanged. The voltage drop between line 27 and electrode 41 remains identical for the lowest electrode voltage and decreases for those drivers having higher electrode voltages. Since current between line 27 and electrode 41 is within fixed limits, power loss is similarly fixed. As heat output is thereby closely controlled, all of the drive circuits of FIG. 1 may be manufactured on chip (miniaturized).

Heat output is thus seen to vary with the voltage on line 27 which, because of the polarity of the diode 47, is a fixed amount above the voltage of the electrode 41 having the lowest voltage. It is possible, such as by reversing the polarity of the diode 47 and changing the polarity of transistor 45 in each current-drive circuit, to have the system similarly respond as described, but to the highest electrode voltage. This would result in consistently higher power dissipation. Also, should any electrode 41 make a faulty contact with a ribbon being driven, a very high potential at Vel would appear and the system would have to be designed to accommodate the resulting other high potentials.

The total amount of current is determined by one other source, which source is controlled by resistors 29*a* and 29*b* in response to the power delivered by adjoining current drive circuit as will be described. The provision of connections to the adjoining current-drive circuit here described is the essential contribution of this invention, the overall drive circuit being the work of coworkers. Line 27*a* joins to line 27 of the circuit through resistor 29*a* as shown in FIG. 1 for the immediately adjacent print electrode 41*a* (FIG. 3) on one side of the electrode driven by the circuit under consideration. Line 27*b* connects through resistor 29*b* to line 27 from the current drive circuit for the electrode 41*b* (FIG. 3) on the opposite side of electrode 41 under consideration. Accordingly, when both of the adjoining electrodes are being driven, voltages on line 27*a* and 27*b* are substantially identical with the voltage on line 27 and no current flows through resistor 29*a* or resistor 29*b*. Where one of the adjoining electrodes 41*a* or 41*b* is not being driven, for example, assuming the electrode 41*a* driven by the circuit through 27*a* is not being driven, then an increased current is supplied to the adjoining circuit. This increased current compensates for the loss of current on the edge of a current pattern since where there is no adjoining application of current, current at the edge spreads and has a less decisive printing effect.

Figure 3:
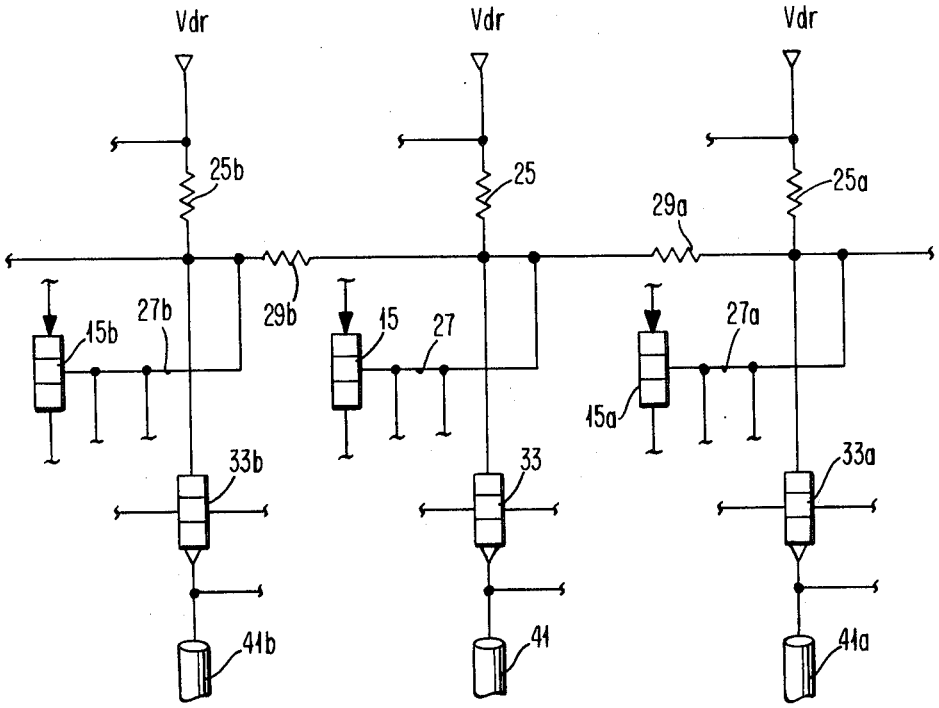
FIG. 3 is a simplified illustration of three adjoining current-drive circuits.

FIG. 3 is a simplified illustration for three adjoining current-drive circuits. Like elements carry like numerals with the subscript "a" for one and "b" for the other.

In the adjoining current drive circuit not selected Vsel at the emitter of transistor 57 (FIG. 1) in that circuit is low and the transistors 3, 15, 31 and 33 are biased off. No substantial current flows through the electrode 41. Accordingly, unless current flows as will be described, Vdr appears on line 27. In adjoining circuits where current is flowing, such as the circuit with line 27*a*, the voltage on line 27*a* is Vdr-Vlev as described. Accordingly, a voltage difference appears across resistor 29*a*. A current is produced by the voltage Vdr − (Vdr-Vlev) across the series relationship of resistor 25 in the adjoining drive circuit and resistor 29*a*. This current appears on line 27 of the circuit being driven and that additional current simply adds directly to the electrode current which drives electrode 41. Where circuits on both sides of a given driven electrode are not being driven, the effect is directly cumulative and the added current is twice that as just described. When three adjoining circuits are all non-selected, Vdr appears on line 27, line 27*a*, and line 27*b*, providing no net voltage across either resistors 29*a* or 29*b*. No added drive current then flows.

In a typical implementation, the resistance of resistors 29*a*, 29*b* and corresponding resistors, each is about five times larger than that of resistor 25. Accordingly, the current added from a single adjoining undriven drive circuit is about one-sixth of the current supplied by a driven circuit. This drops the potential at the next adjoining line corresponding to line 27 to five-sixth of the potential of Vdr. If the drive circuit next to that is undriven, it will add a current defined by Vdr less the potential at that corresponding line 27 divided by the sum of the resistances of 25 and 29. This is in general negligibly small. (The current from the second undriven driver does raise the potential at the corresponding line 27 somewhat. Alternatively, the effect of adjoining undriven circuits can be understood by recognizing that each additional circuit places the sum of resistors corresponding to resistor 25 and resistor 29 in parallel across the preceding resistor corresponding to resistor 25.) If the next further adjacent drive circuit is undriven, its line corresponding to line 27 similarly will be at the potential of the line corresponding to line 27 of the adjoining circuit just discussed. The current added from that will be relatively minute. Theoretically, all undriven drive circuits which adjoin a driven drive circuit add some current as described, although the current from the next adjoining circuit is the only significant and generally desired addition. Where an undriven drive circuit is between driven drive circuits, the closest driven circuit presents the lower voltage and therefore draws all the current from the undriven circuit.

For reasons of design convenience, in an actual circuit, the outer electrodes will not be connected to a still further circuit. This is because the edge definition of the far outer electrodes is rarely important. Similarly, center electrodes are usually driven together. To avoid a connection between chips (the full forty current drivers typically being on two chips) the interconnection by a resistor such as 29*a* or 29*b* across two chips can be eliminated.

Figure 4:
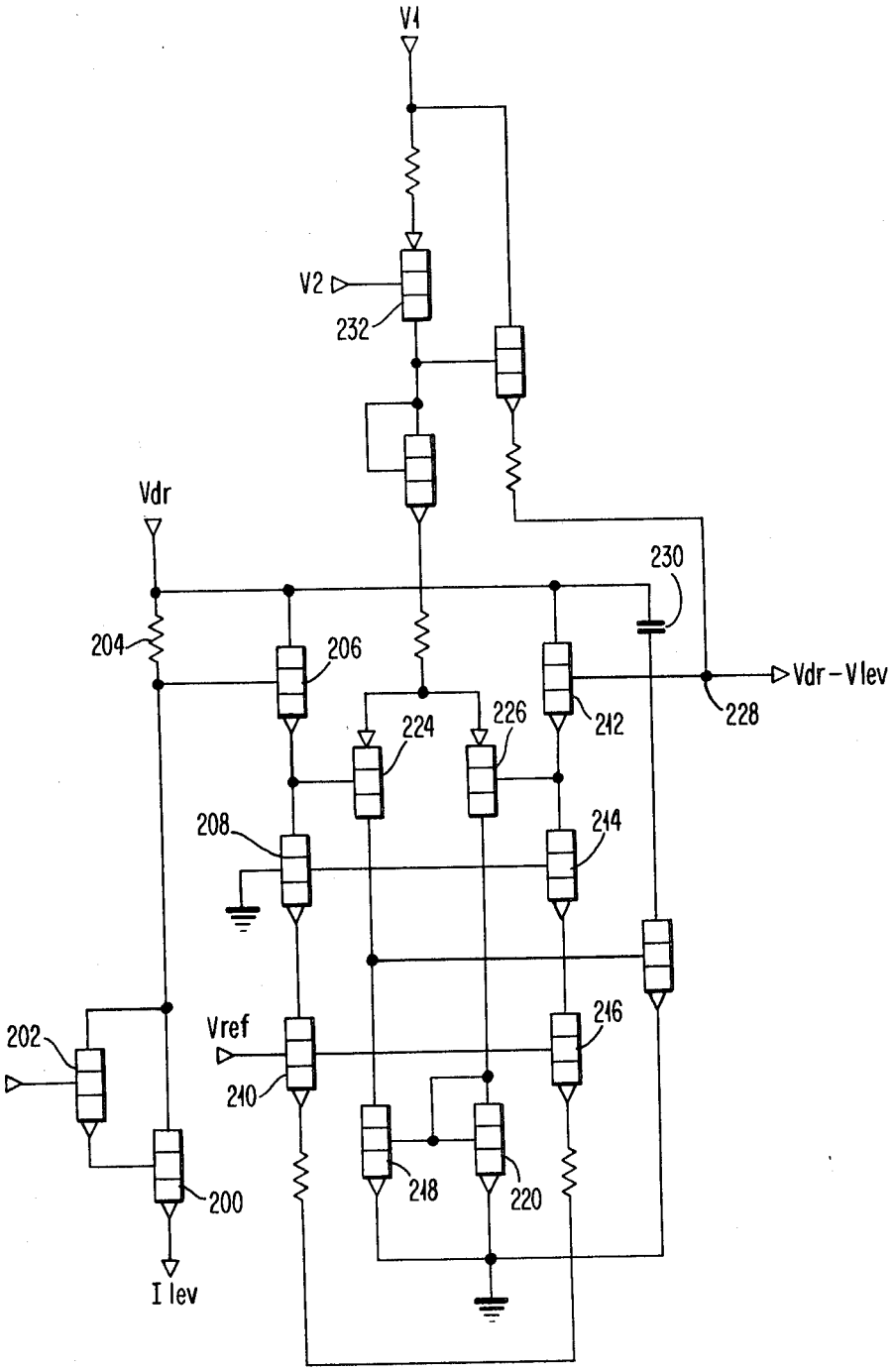
FIG. 4 is a circuit diagram of a variable-reference voltage developing circuit.

Typical generation of the signal Vdr-Vlev will be described briefly by reference to FIG. 4. A level control reference current Ilev is isolated by darlington-connected transistors 200 and 202. Vdr is applied across resistor 204. Transistors 206, 208 and 210 are an emitter-follower circuit providing high input impedance, as are corresponding transistors 212, 214, and 216. Transistors 218 and 220 are a current mirror, each connected in series with transistors 224 and 226, respectively, with their bases connected and the collector of transistor 220 connected to its base. The signal from the collector of transistor 206 is applied to the base of transistor 224.

Accordingly, the base of transistor 224 receives a voltage Vdr minus Ilev times the resistance of resistor 204 minus the base-to-emitter drop across transistor 206. Transistors 224 and 226 constitute a differential amplifier, and this voltage appears on the base of transistor 226. That voltage plus a base-to-emitter drop appears at the base of transistor 212. The voltage component generated by Ilev constitutes Vlev. It appears on line 228 subtracted from Vdr as the output of this variable-reference producing circuit.

Capacitors 230 is a compensation capacitor to prevent oscillations. Transistor 232, connected across operating voltages V1 and V2 provides a constant current source for the circuit.

Variations in circuit design will be readily apparent to those in the art. Accordingly, coverage is based upon the interrelationships and concepts disclosed may not be limited by the preferred embodiment herein described in detail.

I claim:

1. Circuitry for driving electrodes in selected combinations comprising:

a plurality of said electrodes positioned side-by-side;

separate, current-drive circuits, each connected to drive one of said electrodes, each said current-drive circuit having one point connected to carry a first voltage, a first resistance element, and a second point, said resistance element being connected across said first point and said second point, said second point being driven to a second voltage and being connected to drive a first electrode when said current-drive circuit is selected and being isolated from voltages other than said first voltage and disconnected from said first electrode when said current-drive circuit is not selected, and a second resistance element connected across the second point of one of said current-drive circuits and the second point of a second current-drive circuit which drives an electrode contiguous to the electrode driven by said one current-drive circuit.

2. Circuitry for driving electrodes as in claim 1 also comprising a third resistance element connected across the second point of said one current-drive circuit and the second point of a third current-drive circuit which drives an electrode contiguous to the electrode driven by said one current-drive circuit.

3. Circuitry as in claim 2 in which said electrodes driven by said second and said third current-drive circuits are on opposite sides of the electrode driven by said one current-drive circuit.

4. Circuitry as in claim 1 in which said electrodes are positioned in a column.

5. Circuitry as in claim 2 in which said electrodes are positioned in a column.

6. Circuitry as in claim 3 in which said electrodes are positioned in a column.

7. Circuitry as in claim 2 in which said electrodes are in the order of magnitude of forty in number and said second and said third resistance elements are of substantially the same resistance, and the second point of substantially all of the current-drive circuits connected to said electrodes are connected to the second point of all current-drive circuits which drive contiguous electrodes.

8. Circuitry as in claim 3 in which said electrodes are in the order of magnitude of forty in number, said second and said third resistance elements are of substantially the same resistance, and the second point of substantially all of the current-drive circuits connected to said electrodes are connected to the second point of all current-drive circuits which drive contiguous electrodes.

9. Circuitry as in claim 5 in which said electrodes are in the order of magnitude of forty in number, said second and said third resistance elements are of substantially the same resistance, and the second point of substantially all of the current-drive circuits connected to said electrodes are connected to the second point of all current-drive circuits which drive contiguous electrodes.

10. Circuitry as in claim 6 in which said electrodes are in the order of magnitude of forty in number, said second and said third resistance elements are of substantially the same resistance, and the second point of substantially all of the current-drive circuits connected to said electrodes are connected to the second point of all current-drive circuits which drive contiguous electrodes.

11. An edge-effect-compensated electrode-drive system comprising:

a first electrode, a second electrode, and a third electrode, said second electrode being positioned in close proximity to said first electrode and said third electrode, a first current-drive circuit connected to said first electrode, a second current-drive circuit connected to said second electrode, and a third current-drive circuit connected to said third electrode, each said current drive circuit having a first point to receive an operating voltage, a first resistance element with one side connected to said first point, a second point, the other side of said first resistance element being connected to said second point, selection means having one status which connects a reference voltage level to said second point and said second point to the electrode driven by said current-drive circuit, and having another status which removes said reference voltage level and isolates said second point from the electrode driven by said circuit, two second resistance means, one of said second resistance means being connected across the second point of said first current-drive circuit and the second point of said second current-drive circuit, and one of said second resistance means being connected across the second point of said third current-drive circuit and the second point of said second current-drive circuit.

12. The electrode-drive system as in claim 11 in which said first electrode and said third electrode are on opposite sides of said second electrode.

13. The electrode-drive system comprising in the order of magnitude of forty electrodes connected in a system as described in claim 11.

14. The electrode-drive system as in claim 13 in which said electrodes are positioned in a column.

15. Circuitry for driving electrodes in selected combinations comprising:

a plurality of electrodes positioned side-by-side;

separate, current-source circuits, each connected to drive one of said electrodes, each said current-source circuit producing a predetermined current from a point by bringing said one point to a predetermined reference voltage level, said one point being connected to drive a first electrode when said current-source circuit is selected and being at a voltage higher than said reference voltage level and disconnected from said first electrode when said current-drive circuit is not selected, and a first resistance element connected across the one point of one of said current-source circuits and the one point of a second of said current-source circuits which drives an electrode contiguous to the electrode driven by said one current-source circuit.

16. Circuitry for driving electrodes as in claim 15 also comprising a second resistance element connected across the one point of said one current-source circuit and the one point of a third of said current-source circuits which drives an electrode contiguous to the electrode driven by said one current-source circuit.

17. Circuitry as in claim 16 in which said electrodes driven by said second and said third current source circuits are on opposite sides of the electrode driven by said one current-drive circuit.

18. Circuitry as in claim 15 in which said electrodes are positioned in a column.

19. Circuitry as in claim 16 in which said electrodes are positioned in a column.

20. Circuitry as in claim 17 in which said electrodes are positioned in a column.

21. Circuitry as in claim 16 in which said electrodes are in the order of magnitude of forty in number and said first and said second resistance elements are of substantially the same resistance, and the one point of substantially all of said current-source circuits connected to said electrodes are connected to the one point of all said current-source circuits which drive contiguous electrodes.

22. Circuitry as in claim 17 in which said electrodes are in the order of magnitude of forty in number, said first and said second resistance elements are of substantially the same resistance, and the one point of substantially all of said current-source circuits connected to said electrodes are connected to the one point of all said current-source circuits which drive contiguous electrodes.

23. Circuitry as in claim 19 in which said electrodes are in the order of magnitude of forty in number, said first and said second resistance elements are of substantially the same resistance, and the one point of substantially all of said current-source circuits connected to said electrodes are connected to the one point of all said current-source circuits which drive contiguous electrodes.

24. Circuitry as in claim 20 in which said electrodes are in the order of magnitude of forty in number, said first and said second resistance elements are of substantially the same resistance, and the one point of substantially all of said current-source circuits connected to said electrodes are connected to the one point of all said current-source circuits which drive contiguous electrodes.

* * * * *